US009410360B2

(12) United States Patent
Wei

(10) Patent No.: US 9,410,360 B2
(45) Date of Patent: Aug. 9, 2016

(54) DOOR ASSEMBLY

(71) Applicant: Foshan Ideal Co., Ltd, Foshan, Guangdong (CN)

(72) Inventor: Wuxiang Wei, Foshan (CN)

(73) Assignee: Foshan Ideal Co., Ltd., Gaoming, Foshan Guandong (CN)

( * ) Notice: Subject to any disclaimer, the term of this patent is extended or adjusted under 35 U.S.C. 154(b) by 0 days.

(21) Appl. No.: 13/918,552

(22) Filed: Jun. 14, 2013

(65) Prior Publication Data

US 2014/0331565 A1 Nov. 13, 2014

(30) Foreign Application Priority Data

May 13, 2013 (CN) ..... 2013 2 0256871 U

(51) Int. Cl.

| | |
|---|---|
| ***E06B 3/964*** | (2006.01) |
| ***E05D 11/00*** | (2006.01) |
| ***E05D 7/081*** | (2006.01) |
| ***A47K 3/36*** | (2006.01) |
| ***E06B 5/00*** | (2006.01) |
| *A47K 3/30* | (2006.01) |

(52) U.S. Cl.

CPC . *E06B 3/964* (2013.01); *A47K 3/36* (2013.01); *E05D 7/081* (2013.01); *E05D 11/0054* (2013.01); *E06B 5/00* (2013.01); *A47K 2003/307* (2013.01); *E05Y 2201/11* (2013.01); *E05Y 2600/12* (2013.01); *E05Y 2600/14* (2013.01); *E05Y 2600/312* (2013.01); *E05Y 2600/324* (2013.01); *E05Y 2600/502* (2013.01); *E05Y 2600/522* (2013.01); *E05Y 2600/56* (2013.01); *E05Y 2600/62* (2013.01); *E05Y 2900/132* (2013.01)

(58) Field of Classification Search

CPC ..... E06B 1/045; E06B 1/603; E06B 1/6069
USPC ..... 49/504, 505, 55, 176, 177, 396; 4/607, 4/557; 52/126.1, 126.3, 127.7, 656.9
See application file for complete search history.

(56) References Cited

U.S. PATENT DOCUMENTS

| | | | | |
|---|---|---|---|---|
| 3,226,897 | A * | 1/1966 | Dorman | 52/781 |
| 4,251,962 | A * | 2/1981 | Langenhorst | 52/127.7 |
| 4,646,472 | A * | 3/1987 | Sugawara | 49/386 |
| 4,720,876 | A * | 1/1988 | Tomei et al. | 4/614 |
| 4,914,770 | A * | 4/1990 | Baus | 4/612 |
| 4,958,462 | A * | 9/1990 | Cross | 49/181 |

(Continued)

FOREIGN PATENT DOCUMENTS

GB 2 440 605 A 2/2008

*Primary Examiner* — Gregory Strimbu
(74) *Attorney, Agent, or Firm* — Sheppard Mullin Richter & Hampton LLP

(57) ABSTRACT

A door assembly comprises a stationary frame, a movable frame, and an adjusting assembly. The adjusting assembly comprises an adjusting element detachably connected with the stationary frame and having a rod portion; a fixing element connected with the movable frame and having a cavity for receiving the rod portion; and a cam member disposed adjacent to the cavity and movable between an open position in which the movable frame is movable relative to the stationary frame and a closed position in which the movable frame is fixed relative to the stationary frame. The door assembly can be assembled without drilling, minimizing risk of damage to the frames, and can be assembled by a single person.

8 Claims, 6 Drawing Sheets

(56) References Cited

U.S. PATENT DOCUMENTS 6,058,665 A * 5/2000 Halvorson et al. ..... 52/205
6,550,184 B1 * 4/2003 O'Donnell et al. ..... 49/181
7,905,058 B2 * 3/2011 Massey et al. ..... 49/365
8,733,026 B1 * 5/2014 Wei ..... E05D 11/0054 49/505
2003/0019030 A1 * 1/2003 Kopacz et al. ..... 4/607
2009/0241610 A1 * 10/2009 Watts et al. ..... 70/91
2012/0279166 A1 * 11/2012 Valler et al. ..... 52/656.2

* cited by examiner

DOOR ASSEMBLY

CROSS-REFERENCE TO RELATED DOCUMENT

This application claims priority benefit from Chinese utility model application No. 201320256871.0 filed on 13 May 2013 in the name of Foshan Ideal Co., Ltd., the disclosure of which is incorporated herein by reference in its integrity.

FIELD OF THE INVENTION

The present invention relates to a door assembly, and in particular, to an adjusting assembly used therein for the adjusting of a stationary frame and a movable frame of the door assembly.

BACKGROUND OF THE INVENTION

Doors, such as shower doors or balcony doors, are often mounted against wall surfaces and the doors thus mounted are kept as vertical as possible. However, the wall surfaces of buildings are often not exactly vertical, for example, titled toward outside/inside by an angle. Therefore, if the doors are mounted completely along the wall surface, the doors may not be smoothly opened or closed. In this regard, it is necessary to adjust the distances between the top/bottom end of a door and a wall surface so as to keep the door in a vertical position.

To achieve this adjustment, a door assembly usually comprises a stationary frame to be attached to a wall surface, and a movable frame connected with a door panel, such as a glass door panel. The stationary frame is firstly attached to the wall surface and then the movable frame is moved toward the stationary frame, during which the distances between the top and bottom ends of the movable frame, and the stationary frame are such adjusted that the movable frame is in a vertical position, and in turn, the door panel is also in a vertical position. The stationary and movable frames are finally connected to each other by drilling thereon and by using fasteners.

However, in one aspect, the drilling operation requires at least two people to cooperate and is very time-consuming. In another aspect, the drilling may inadvertently cause damages to the surfaces of the frames (generally made of aluminum materials), which is undesirable to consumers.

SUMMARY OF THE INVENTION

An object of the present invention is to provide a door assembly which can be mounted without drilling. Another object of the invention is to provide a door assembly that can be mounted by a single person.

To achieve the objectives, a door assembly is provided which comprises a stationary frame and a movable frame. The door assembly further comprises an adjusting assembly comprising an adjusting element detachably connected with the stationary frame and having a rod portion; a fixing element detachably connected with the movable frame and having a first cavity at its top for receiving the rod portion and a second cavity at one side; and a cam member receivable in the second cavity, the cam member being rotatably connected to the fixing element and movable between an open position and a closed position.

When the cam member is in the open position, it does not interfere the movement of the rod portion such that the latter is freely extendable and retractable within the first cavity. The distance between the stationary and movable frames is thus variable. When the cam member is in the closed position, it applies a force to one sidewall of the rod portion such that the other sidewall of the rod portion will apply a force to the fixing element. Finally, the cam member, rod portion and fixing element are secured together, so that the stationary and movable frames are also secured.

Preferably, the fixing element further comprises a cushion received within the first cavity for contacting with the rod portion to increase the friction force there between. Preferably, the cushion is made of rubber or plastic materials.

Preferably, the cushion has at least one wing, and the fixing element has correspondingly at least one recess for accommodating the at least wing such that the cushion will not displace in axial direction.

Preferably, the cushion has a transversal fixing portion for coupling with the fixing element in transverse direction.

Preferably, the rod portion has at least one sidewalls provided with engaging elements, for engaging with the cam member and/or fixing element and/or the cushion. The engaging elements are preferably teeth.

Preferably, the cam member comprises a handle and a cam portion formed at one end of the handle and substantively perpendicular to the handle. The cam portion has a bulge at its free end, for contacting with and pressing against the rod portion. The surface of the bulge that is in contact with the rod portion preferably has engaging elements, such as teeth.

The adjusting element preferably has a fixing portion substantively perpendicular to the rod portion, for detachable connection with the stationary frame. The fixing portion preferably has guiding ribs and the stationary frame has a groove, such that the guiding ribs can be inserted into to the groove so as to connect with the stationary frame.

The fixing element preferably has slots on its sides, for receiving both sidewalls of the stationary frame.

The fixing element preferably has a first through hole, and the movable frame has a receiving tube. In this case, the fixing element is secured to the movable frame by a fastener passing through the first through hole and penetrating into the receiving tube.

The fixing element preferably has a second through hole for engaging with a door panel, in particular, a pivot door panel.

The door assembly preferably has a decorative element for housing at least a part of the adjusting assembly for purpose of aesthetics.

The door assembly of the present invention is preferably shower door, balcony door or other sliding doors, more preferably shower door.

The door assembly provided in the present invention can be assembled without drilling operation, minimizing risk of damage to the frames, and can be assembled by a single person.

Elements that are irrelevant to the spirit of the invention are omitted from the drawings for purpose of clarity.

DETAILED DESCRIPTION OF THE INVENTION

The present invention will now be described in more detail in reference to the drawings. It should be noted that the terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" include any and all combinations of one or more of the associated listed items. It will be further understood that the terms "comprises" "comprising" "includes" and/or "including" when used herein, specify the presence of stated features, integers, steps, operations, elements, and/or components, but do not preclude the presence or addition of one or more other features, integers, steps, operations, elements, components, and/or groups thereof.

Figure 1:
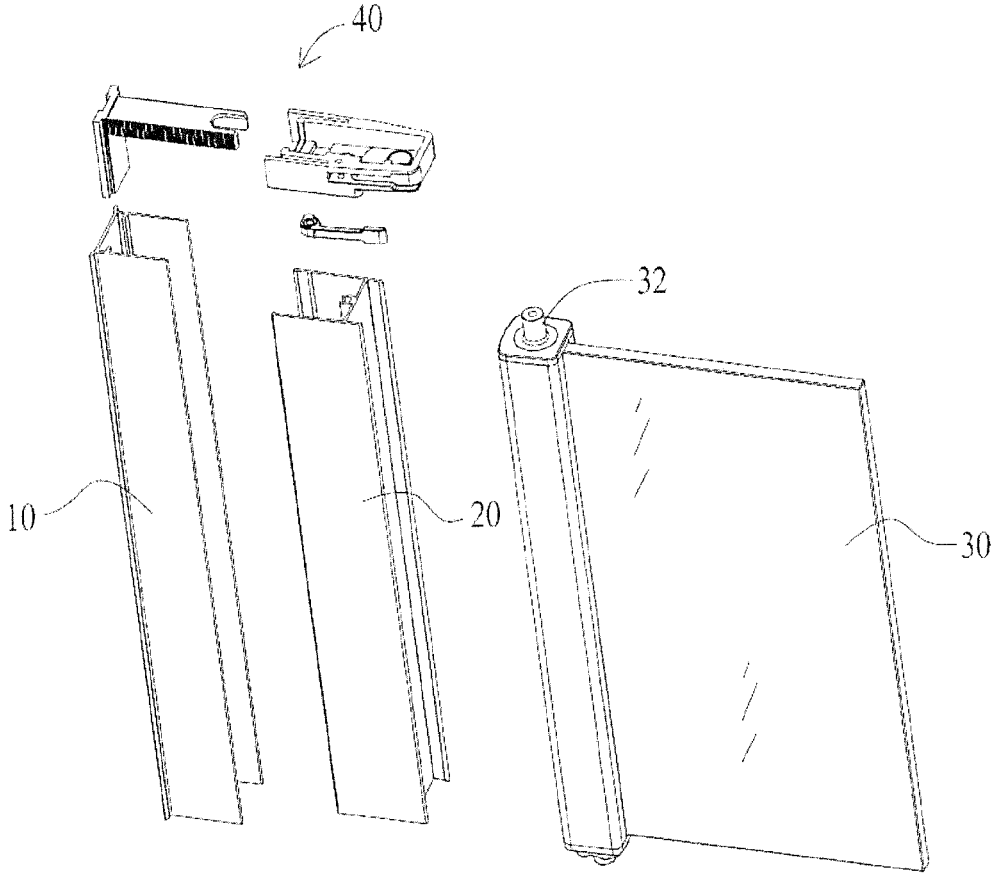
FIG. 1 shows primary elements and position relationship of an exemplary door assembly according to one embodiment of the invention.

FIG. 1 shows an exemplary door assembly which is a pivot door assembly used generally in a bathroom. The pivot door assembly comprises a stationary frame 10, a movable frame 20, a pivot door panel 30 and an adjusting assembly designated as number 40 in general. The stationary frame 10 is attached to a wall surface by for example providing a through hole on the frame and using a fastener to passing through the hole and penetrating into the wall surface, or by adhesives. It can be contemplated that the stationary frame 10 can be attached to a wall surface through other methods known in the art.

In the present example, the movable frame 20 is coupled with the pivot door panel 30 through the adjusting assembly 40. The adjustments of the distance between the top end of the movable frame 20 and the stationary frame 10 and the distance between the bottom end of the movable frame 20 and the stationary frame 10 will enable the movable frame 20 to be in a vertical position. For example, when the wall surface is in a vertical position, the movable frame 20 will also be in a vertical position when the top and bottom ends of the movable frame 20 equally spaced from the stationary frame 10. For example, when the wall surface is titled outside by an angle, the movable frame 20 will be in a vertical position when the distance between the top end of the frame 20 and the frame 10 is appropriately larger than that between the bottom end of the frame 20 and the frame 10. Yet for example, when the wall surface is titled inside by an angle, the movable frame 20 will be in a vertical position when the distance between the top end of the frame 20 and the frame 10 is appropriately smaller than that between the bottom end of the frame 20 and the frame 10. When the movable frame 20 is in vertical position, the pivot door panel 30 which is connected to the frame 20 is also in a vertical position, such that the door panel 30 can be opened or closed freely.

Figure 2:
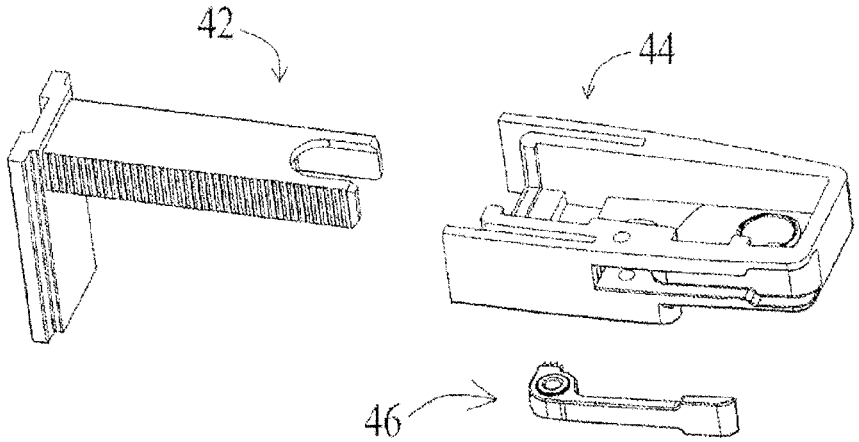
FIG. 2 shows the primary elements of an adjusting assembly shown in FIG. 1.
Figure 3:
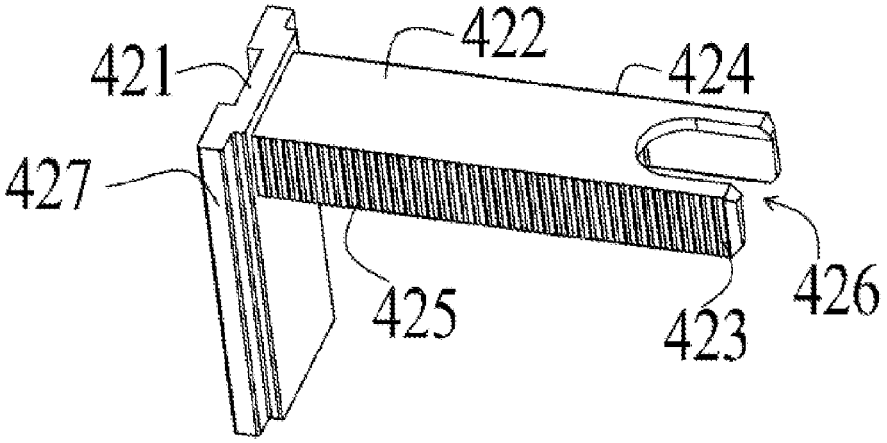
FIG. 3 shows the detailed structure of an adjusting element shown in FIG. 1.

FIG. 2 shows the adjusting assembly 40 in detail, which comprise an adjusting element 42, a fixing element 44 and a cam member 46. As shown in FIGS. 1 and 2, the adjusting element 42 is connected with the stationary frame 10, the fixing element 44 is connected with the movable frame 20, and the cam member 46 is connected with the fixing element 44. FIG. 3 shows in detail the adjusting element 42. The adjusting element 42 comprises a fixing portion 421 and a rod portion 422 substantively perpendicular to the fixing portion 421. The fixing portion 421 is used for detachably connected with the stationary frame 10. In the present example, the fixing portion 421 has guiding ribs 427, and the frame 10 correspondingly has a groove 16 (see FIG. 8). The guiding ribs 427 can insert into the groove 16 such that the adjusting element 42 is connected to the frame 10.

The rod portion 422 has two sidewalls 423, 424, which are distributed with teeth 425. It can be contemplated that the teeth 425 can also be absent. The sidewalls 423, 424 can also be smooth surfaces. Alternatively, the teeth 425 can exist on only one of the sidewalls. The teeth 425 are provided to make the engagement between the rod portion and other parts stronger and reliable. In this example, a notch 426 is formed at free end of the rod portion 422, for cooperation with the pivot door panel 30, which will be described in detail later on. It will be appreciated that when the pivot door panel is connected to the movable frame in a different form, or when different door panels are used, the notch 426 may not be necessary.

Figure 4:
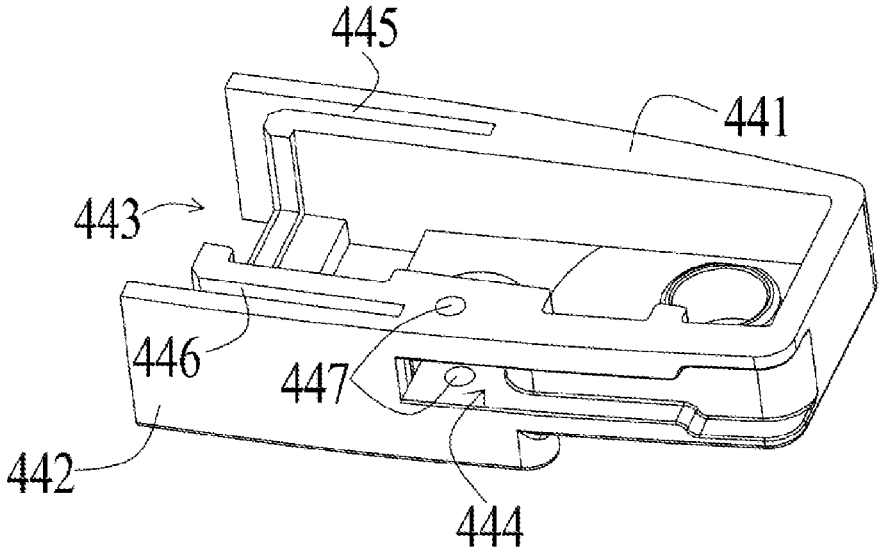
FIGS. 4 and 5 show a fixing element and a cam member shown in FIG. 1 in detail.
Figure 5:
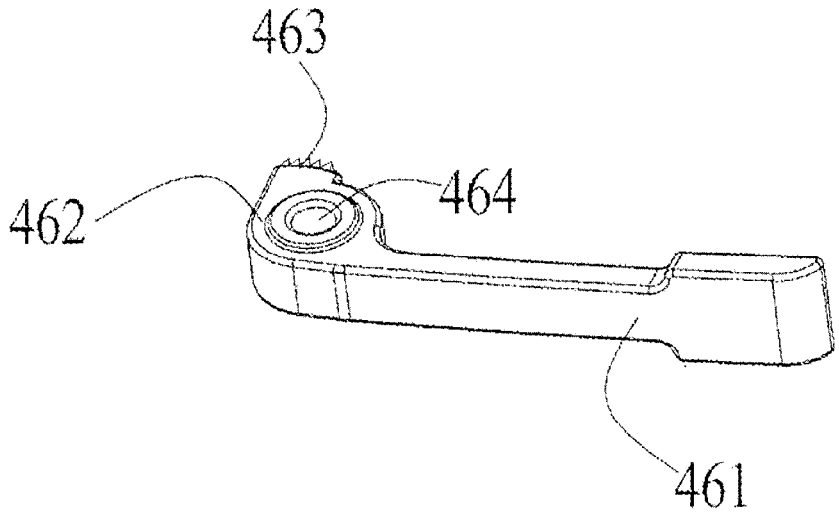

FIGS. 4 and 5 show the detailed structures of the fixing element 44 and the cam member 46. The fixing element 44 comprises two sides 441, 442, a first cavity 443 located at its top, and a second cavity 444 formed on one side 442. The first cavity 443 is used for receiving the rod portion 422. When the rod portion 422 is not interfered, it can freely extend into and exit from the first cavity 443, such that the relative position between the stationary frame 10 and the movable frame 20 can be freely changed. The second cavity 444 is used for receiving the cam member 46 and has a same shape as the contour of the cam member 46. The cam member 46 can be connected to and rotate around the fixing element 44, and can be movable between an open position, in which the cam member 46 does not interfere with the rod portion 422, and a closed position, in which the cam member 46 applies a force to the sidewall 423 of the rod portion 422 such that the other sidewall 424 of the rod portion 422 applies a force to the side 441 of the fixing element 44. The rod portion 422, fixing element 44 and the cam member 46 are thus secured together. The stationary frame 10 and the movable frame 20 thus can not displace with respect to each other.

The cam member 46 has a handle 461 and a cam portion 462 formed at one end of the handle 461 and substantively perpendicular thereto. The cam portion 462 has a through hole 464 which cooperates with two pin holes 447 provided on the side 442 of the fixing element 44 to enable the cam member 46 to rotate with a pin (not shown). The cam portion 462 has a bulge 463 for contacting with and pressing against the rod portion 422 in the closed position. In this example, the surface of the bulge 463 that is in contact of the rod portion 422 is a smooth surface. It can be contemplated that the surface can also be provided with engaging elements such as teeth, to facilitate the engagement between the bulge 463 and the sidewall 423 of the rod portion 422. The sidewall 423 and said surface can both have teeth, such that the engagement of the teeth makes the coupling between the cam member 46 and the adjusting element 42 more stable and reliable.

Figure 6:
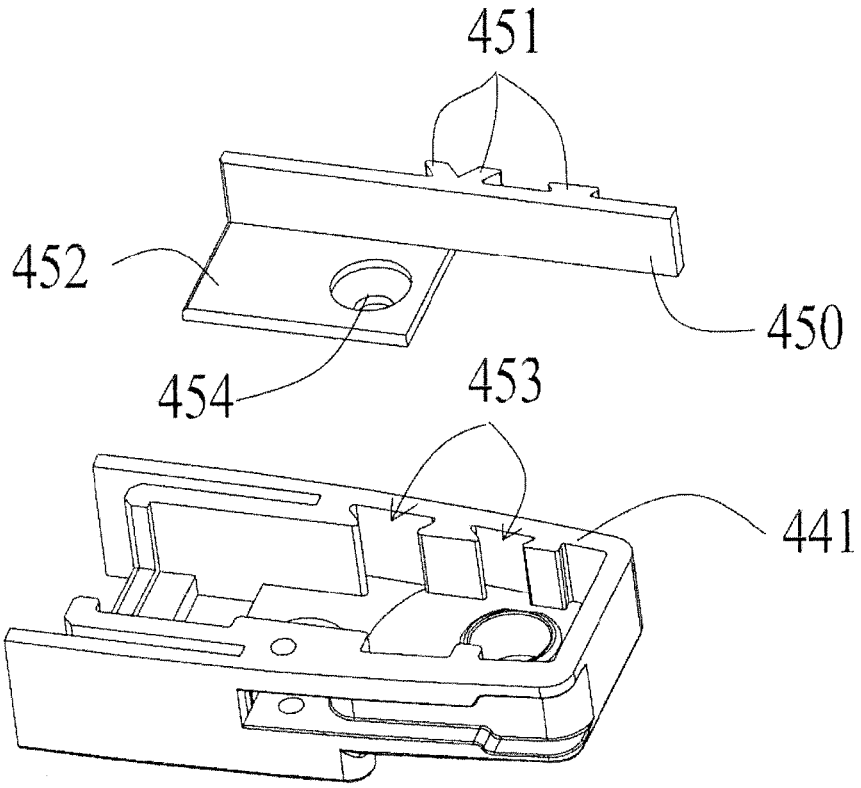
FIG. 6 shows another embodiment of the fixing element.

FIG. 6 shows another form of the fixing element of the invention. In this example, the fixing element 44 further comprises a cushion 450 which is receivable in the first cavity 443.

The cushion 450 has at least one wing 451, and the side 441 of the fixing element 44 has at least one recess 453. The wing 451 can be embedded into the recess 453 such that the cushion will not displace in the longitudinal direction X (see FIG. 7).

The cushion 450 is made of rubber or plastic materials in this example. It is to be contacted with the side 424 of the rod portion 422 to increase the friction force there between, in order to ensure that the adjusting element 42 is not displaced in the longitudinal direction X. Preferably, the side 424 is also provided with engaging elements such as teeth, such that the teeth will pierce into the cushion 450 to secure the rod portion with the cushion 450. The cushion 450 can be coupled with the fixing element 44 in suitable manners. In the present example, the cushion 450 has a transversal fixing portion 452, generally in sheet form, so as to fit the bottom of the first cavity 443 and be able not to block the movement of the rod portion 422. The transversal fixing portion 452 further has a through hole 454 for achieving the connection between the fixing element 44 and the movable frame 20. It can be contemplated that the cushion 450 can be connected with the fixing element 44 in a different manner such that the transversal fixing portion 452 may be omitted or replaced.

Figure 7:
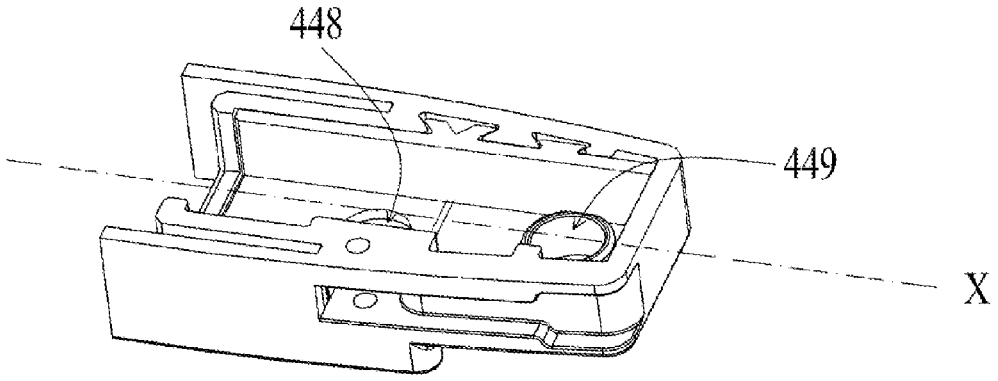
FIG. 7 shows the fixing element as shown in FIG. 6 in an assembly state.
Figure 8:
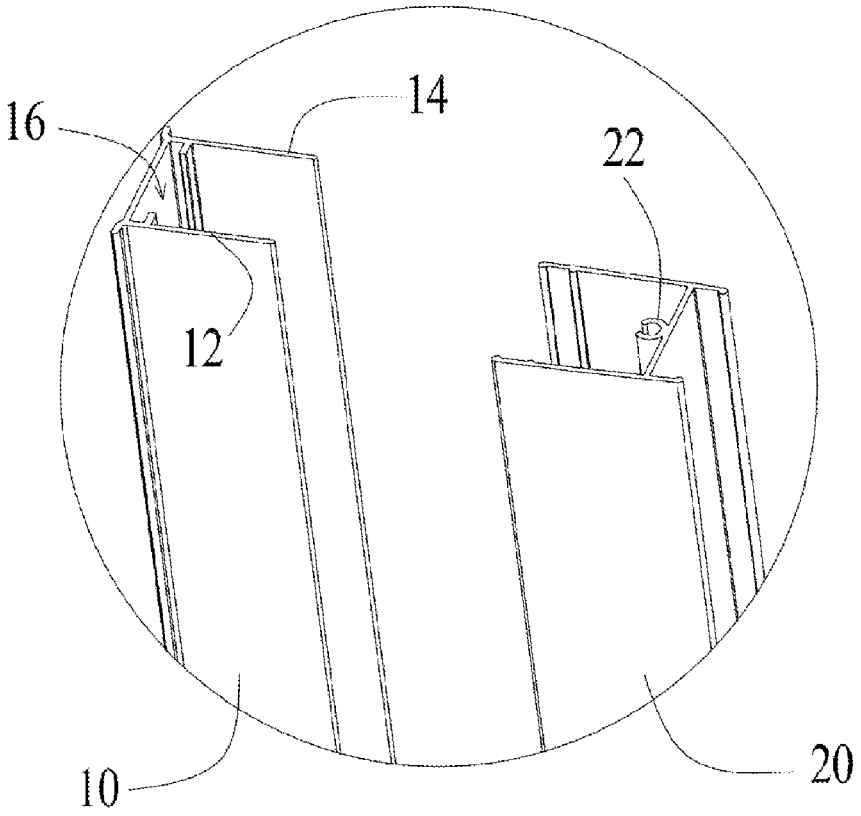
FIG. 8 shows the top portions of the stationary and movable frames.

The fixing element 44 can be detachably attached to the movable frame 20 in suitable manners. In one example, as shown in FIG. 7, the fixing element 44 has a through hole 448. Correspondingly, as shown in FIG. 8, the movable frame 20 has a receiving tube 22. The through hole 454 of the transversal fixing portion 452, the through hole 448 of the fixing element 44 and the receiving tube 22 are aligned such that a fastener can pass through the holes 454, 448 and inserting into the receiving tube 22, such that the cushion 450 and the fixing element 44 are disposed at the top end of the movable frame 20. It can be contemplated that the cushion, fixing element and the movable frame can be detachably connected with each other by other methods known in the art. The fixing element 44 also can be provided with a through hole 449 for passing through of the shaft 32 of the pivot door panel 30, so as to secure the panel 30, movable frame 20 and the fixing element 44 together.

In the present invention, the door assembly comprises two adjusting assemblies 40, located at top and bottom ends of the stationary/movable frame respectively. The description above is set forth with reference to the arrangement of the adjusting assembly on the top ends of the frames. It can be contemplated that the arrangement of the adjusting assembly at the bottom ends can be carried out in a same or similar way.

Figure 9:
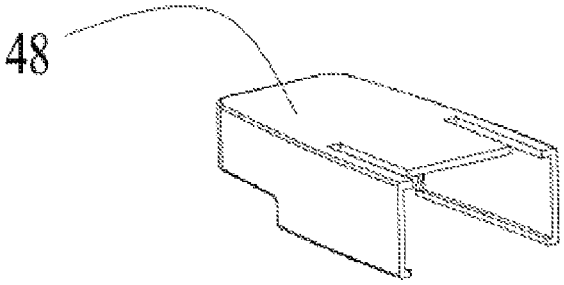
FIG. 9 shows a decorative element in an illustrative view.
Figure 10:
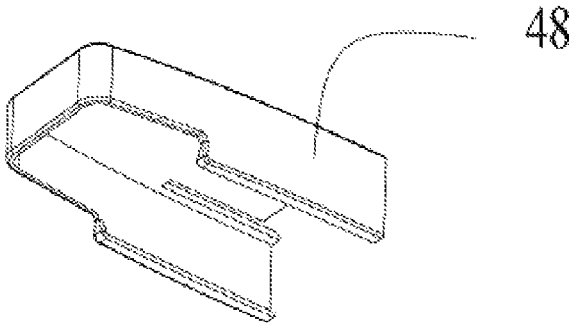
FIG. 10 shows a decorative element in another illustrative view.

As shown in FIGS. 9 and 10, the adjusting assembly can also comprise a decorative element 48 for covering at least a part of the adjusting assembly 40 so that the fixing element and adjusting element are not visible from outside, for the purpose of aesthetics.

During assembly, the stationary frame 10 is attached to a wall surface, and the adjusting element 42 is then attached to the stationary frame 10. The movable frame 20, cam member 46, fixing element 44, door panel 30, and, optionally, the cushion 450 are connected together, and keep the cam member 46 in open position. The movable frame 20 is then moved toward the stationary frame 10. As the cam member 46 is in open position, it will not interfere the movement of the rod portion 422. The rod portion 422 can inserted into the first cavity 443, and in the meantime, the two sidewalls 12, 14 (see FIG. 8) of the stationary frame 10 are inserted into the slots 445, 446 of the fixing element 44. The distances between the top/bottom ends of the movable frame 20 and the stationary frame 10 are such adjusted that the movable frame 20 is in a vertical position.

When the movable frame 20 is in a vertical position, the handle 461 is rotated to move the cam member 46 to the closed position. In this position, the bulge 463 applies a force to the rod portion 422, which in turn directly or through the cushion 450 applies a force to the fixing element 44, so as to secure the rod portion 422 and fixing element 44 together.

Figure 11:
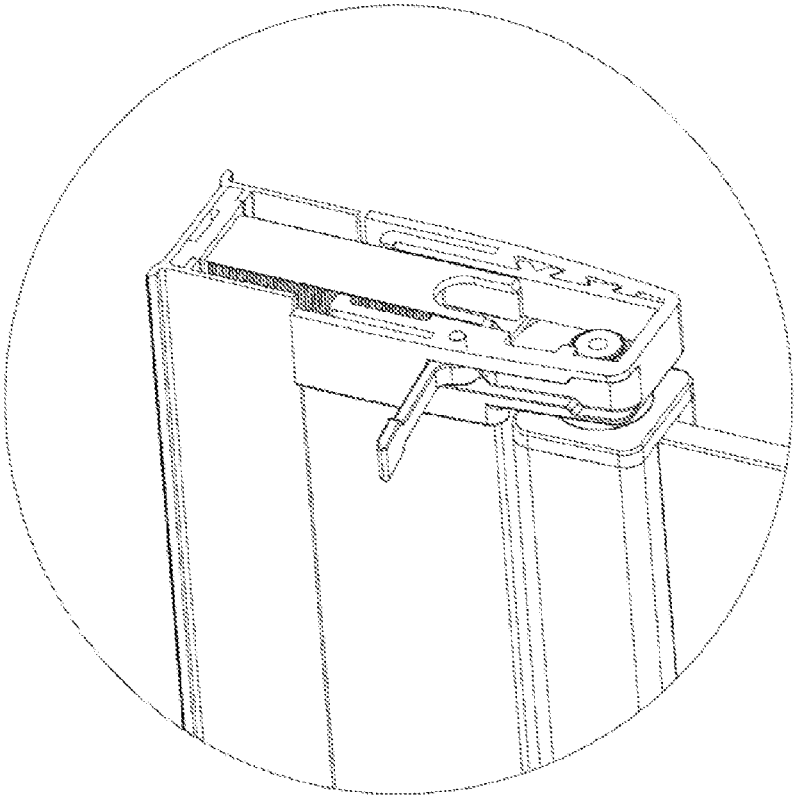
FIG. 11 shows a partial view of door assembly when the cam member is in an open position.
Figure 12:
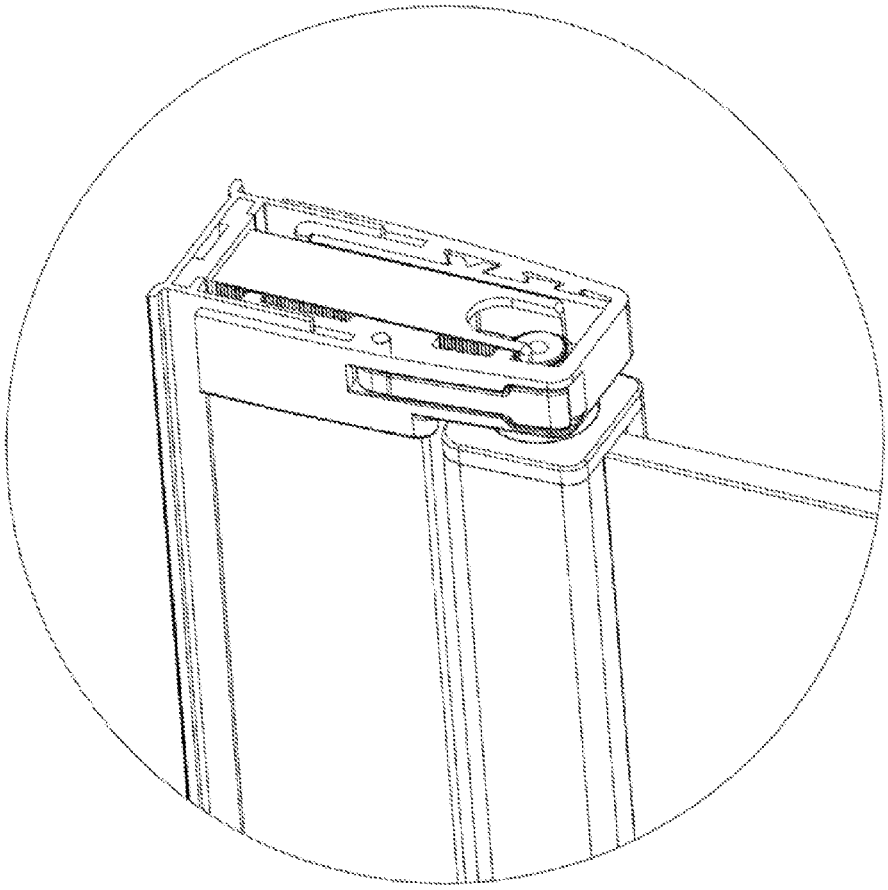
FIG. 12 shows a partial view of door assembly when the cam member is in a closed position.

FIGS. 11 and 12 show the door assembly when the cam member 46 in open and closed positions respectively. As can be seen, when the handle 461 is completely received within the second cavity 444, the cam member 46 is closely secured with the rod portion 422, cushion 450 and the fixing element 44, so as to secure the relative position between the stationary frame 10 and the movable frame 20. When the handle 461 is clockwise rotated by 90°, the cam member 46 is moved out of the cavity 444 and the bulge 463 is released from the rod portion 422, such that the rod portion 422 can again extend into or exist from the first cavity 443 so as to adjust the distance between the stationary frame 10 and the movable frame 20. The adjusting assemblies disposed at the top and bottom ends of the frames are operated in a similar/same way.

It should be understood that various example embodiments have been described with reference to the accompanying drawings in which only some example embodiments are shown. The present invention, however, may be embodied in many alternate forms and should not be construed as limited to only the example embodiments set forth herein.

What is claimed is:

1. A door assembly comprising;

a stationary frame for connecting said door assembly with a wall;

a movable frame for supporting a door panel; and an adjusting assembly for connecting said movable frame with said stationary frame; wherein said adjusting assembly comprises:

an adjusting element connected with said stationary frame and having a rod portion;

a fixing element connected with the movable frame and having a cavity for receiving said rod portion; and a cam member disposed adjacent to said cavity, said cam member is movable between an open position in which said movable frame is movable relative to said stationary frame and a closed position in which said cam member engages with said rod portion such that said movable frame is fixed relative to said stationary frame, wherein the fixing element further comprises a cushion within the cavity for increasing a friction force between the fixing element and said rod portion when said cam member is in said closed position, and wherein at least one sidewall of the rod portion comprises teeth.

2. The door assembly of claim 1, wherein the cam member is disposed on one side of said cavity, the cam member comprises a handle and a cam portion formed at one end of the handle, and the cam portion is provided with a bulge for contacting with and pressing against the rod portion.

3. The door assembly of claim 2, wherein the bulge has a surface that is provided with engaging elements.

4. The door assembly of claim 3, wherein the engaging elements are teeth.

5. The door assembly of claim 1, wherein the adjusting element further comprises a fixing portion extending in a direction substantively perpendicular to a longitudinal axis of the rod portion, and the fixing portion includes guiding ribs.

6. The door assembly of claim 1, wherein the adjusting assembly further comprises a decorative element for covering at least a part of the adjusting assembly.

7. The door assembly of claim 1, wherein the door assembly is a shower door assembly.

8. The door assembly of claim 1, wherein the door assembly is a balcony door assembly.

* * * * *